US012420158B2

(12) United States Patent
Adams

(10) Patent No.: US 12,420,158 B2
(45) Date of Patent: Sep. 23, 2025

(54) BALL RETURN SYSTEM

(71) Applicant: OpenGym LLC, Flower Mound, TX (US)

(72) Inventor: Christopher Adams, Flower mound, TX (US)

(73) Assignee: Open Gym LLC, Flower Mound, TX (US)

( * ) Notice: Subject to any disclaimer, the term of this patent is extended or adjusted under 35 U.S.C. 154(b) by 243 days.

(21) Appl. No.: 18/227,909

(22) Filed: Jul. 29, 2023

(65) Prior Publication Data

US 2025/0032878 A1 Jan. 30, 2025

(51) Int. Cl.

| | |
|---|---|
| ***A63B 69/00*** | (2006.01) |
| ***A63B 63/08*** | (2006.01) |
| ***A63B 69/40*** | (2006.01) |
| ***A63B 71/02*** | (2006.01) |
| *A63B 63/00* | (2006.01) |

(52) U.S. Cl.

CPC ..... *A63B 69/0071* (2013.01); *A63B 63/083* (2013.01); *A63B 69/40* (2013.01); *A63B 71/03* (2020.08); *A63B 2063/001* (2013.01); *A63B 2069/402* (2013.01); *A63B 2220/805* (2013.01)

(58) Field of Classification Search

CPC ..... A63B 69/0071

See application file for complete search history.

(56) References Cited

U.S. PATENT DOCUMENTS

| | | | | |
|---|---|---|---|---|
| 8,123,634 | B1 * | 2/2012 | Lovett | A63B 47/02 473/436 |
| 11,577,139 | B1 * | 2/2023 | Campbell | A63B 69/407 |
| 2010/0018936 | A1 * | 1/2010 | Di Donato | A63B 47/002 211/8 |
| 2017/0282044 | A1 * | 10/2017 | Moore | A63B 47/02 |
| 2020/0353333 | A1 * | 11/2020 | Brown | A63B 24/0021 |
| 2023/0241456 | A1 * | 8/2023 | Cox | A63B 69/0015 473/422 |
| 2024/0157401 | A1 * | 5/2024 | Johnson | B07C 5/3422 |

* cited by examiner

*Primary Examiner* — Eugene L Kim

(74) *Attorney, Agent, or Firm* — Shalchi Law PC; Ali Shalchi, Esq.

(57) ABSTRACT

A ball return system is integrated with a playing surface upon which a player trains, and includes a ball storage mechanism, ball passing device, and a track structure. The storage mechanism has one or more ball transport mechanisms, ball sorting mechanisms, ball storage groups, and a ball release mechanism. The ball passing device is configured to accept expelled balls from the release mechanism, and to pivot via panning and tilting. The track structure has lateral and vertical motion mechanisms and is configured to raise and lower the lateral motion mechanism. The ball return system also includes optical sensors to capture visual data from player characteristics, location, and movements and a system controller that receives data from the optical sensors and is in two-way communication with a plurality of sub-controllers for passing, lateral motion, vertical motion, and ball release.

10 Claims, 6 Drawing Sheets

BALL RETURN SYSTEM

FIELD OF THE INVENTION

This disclosure relates to the field of sports training systems.

BACKGROUND

Practicing shooting in basketball requires that a basketball be passed to an athlete who is training. Currently, there are two common options. The first is a manual option, whereby a second person retrieves and then passes the ball to the athlete who is training. The second option consists of one of several commercially available machines which operate at one physical location-under the hoop. This allows for capturing previously shot basketballs so that they can be passed back to the athlete. These machines are limited in passing ability since they must pass from a fixed location. They may use variable force, and may rotate to pass in different directions, however they are still relegated to a single position under the hoop.

Other machines have small caster wheels and can be rolled around manually, requiring additional attention and labor from an assistant, and requiring storage. Many of these machines utilize some manner of "punching" or "catapulting" in order to "launch" the ball to a location. There is no spin applied to such passes, which are often delivered with a wobbly trajectory as a result. Additionally, current solutions have manual passing-force adjustments via a spring under tension, requiring the athlete to be in a narrow range of positions to catch the passed ball. These passing machines often sit low to the ground, delivering the ball with an arc-shaped trajectory which attempts to simulate a "chest pass" typically used in the game of basketball, but the result can be unnatural. Programming and software associated with current passing machines remain limited, offering only minimal and basic repositioning schemes. As a further matter, basketballs come in two or more sizes based on player type, varying based on age and gender groups. Current passing machines are unable to distinguish between the balls, or to recognize any other elements on the court-including the athletes. When balls of varying size are required, players typically must take turns depending on which ball has been loaded into the passing machine.

There is a need in the art for systems and mechanisms that allow an athlete to seamlessly and efficiently explore different positions on the court while receiving a steady supply of new balls for shot-taking. Moreover, there is a need to advance the art with modern technologies which can integrate with standard courts to help make training more efficient and fun.

SUMMARY

A ball return system is provided. In an exemplary embodiment, the ball return system is integrated with a playing surface upon which a player trains, wherein the ball return system comprises a ball return mechanism having a ball storage mechanism with one or more ball transport mechanisms configured to receive balls and move them through the storage mechanism, one or more ball sorting mechanisms configured to selectively discharge the balls within the storage mechanism, one or more ball storage groups, and a ball release mechanism, wherein the balls are firstly received by the one or more transport mechanisms, secondly organized by the one or more sorting mechanisms into the one or more storage groups, and thirdly expelled from the storage mechanism by the release mechanism. The ball return mechanism also includes a ball passing device configured to accept the expelled balls from the release mechanism and to pivot via panning and tilting. The ball return mechanism also includes a track structure having both lateral and vertical motion mechanisms, wherein the vertical motion mechanism comprising two parallel vertical rails, each rail extending perpendicularly away from the playing surface, the lateral motion mechanism comprising a lateral rail running orthogonally to and being slidably engaged with the vertical rails, the passing device being slidably mounted to the lateral motion mechanism, wherein the vertical motion mechanism is configured to raise and lower the lateral motion mechanism with passing device, while both the lateral motion mechanism and passing device are mutually configured to provide linear motion of the passing device along the lateral rail, wherein the passing device simultaneously projects the balls onto the playing surface while pivoting and moving vertically, laterally, and diagonally relative to the playing surface via said motion mechanisms. The ball return system further comprises optical sensors and a system controller, the system controller receiving data from the optical sensors, the system controller further being in two-way communication with sub-controllers, including a passing controller, a lateral motion controller, a vertical motion controller, and the ball release mechanism, wherein the optical sensors capture visual data from player characteristics, location, and movements, wherein the system controller automatically translates this data into sub-controller commands in real-time during training to affect one or more of the following: the vertical and lateral positions of the passing device, the pivoting of the passing device, and the releasing of balls into the passing device, wherein the above plurality of varied vertical, lateral, and pivoted positions of the passing device provide chest passes, bounce passes, and lob passes directed at the player based on the visual data, and wherein the system controller optionally executes the sub-controller commands based on system presets, manual controls, or external processing of the visual data.

In one aspect, the passing device is configured to vary the level of spin and force on the projected ball, and wherein changes to these parameters are executed by the passing controller based on the visual data. In another embodiment, one or more of the transport mechanisms further comprise an entry point through which the balls are received, wherein the received balls include those from missed shot attempts made by the player, wherein one or more of the ball sorting mechanisms organize the balls by size, and wherein the release mechanism includes a conduit providing a ball pathway to the passing device. In another aspect, one or more of the entry points are positioned at the level of the playing surface, and wherein a first storage group holds a first size of ball and a second storage group holds a second size of ball.

In another aspect, the conduit is flexible, and wherein both the vertical and lateral motion mechanisms are configured to provide infinite repositioning of the passing device along the track structure. In another aspect, the system presets can be global or player-specific. In another aspect, the visual data includes hand gestures and shot attempts by the player, including missed or made shots, wherein the hand gestures can initiate passes, and wherein variations of hand gestures are associated with different types of passes. In another aspect, the player-specific system presets can be age-based. In one aspect, the external processing is cloud-based, wherein one or more of the transport mechanisms further comprise an entry point through which the balls are received, wherein the received balls include those from missed shot attempts made by the player, and wherein one or more of the ball sorting mechanisms organize the balls by size. In another aspect, the track structure is configured to provide linear motion of the passing device in an additional direction running orthogonally to both the vertical and lateral motion.

In another embodiment, a ball return mechanism for passing balls to a player positioned on a playing surface includes a lateral motion mechanism surrounding the playing surface, and a passing device slidably mounted to the lateral motion mechanism, wherein the passing device is configured to move parallel to imaginary first and second axes, the two axes running orthogonally to each other, and wherein the passing device is further configured to provide chest passes, bounce passes, and lob passes with variable force and spin toward the player while simultaneously varying its position along the lateral motion mechanism as the player varies their position on the playing surface. In one aspect, the passing device is configured to pivot via panning and tilting, wherein the lateral motion mechanism includes a track structure having a first, second, and third rail, the rails being straight and coplanar, wherein the first rail corresponds to the first imaginary axis, while the second and third rails correspond to the second imaginary axis. In another aspect the second and third rails connect to the first rail via terminal curvatures, the ball passing device being configured to travel between the three rails via the curvatures. In one aspect the ball return mechanism includes a ball storage mechanism configured to receive the balls, sort the balls according to size, and release the balls to the passing device. In another aspect the ball return mechanism is remotely programmable and operable via a system controller in two-way communication with the ball return mechanism, wherein a plurality of cameras capture real-time visual data from the player, the system controller configured to receive and process this data, and wherein the system controller automatically converts the data into commands which alter the type of pass, and which also direct the pass to the player positioned on the playing surface.

In another embodiment, a ball return system for passing balls to a player positioned on a playing surface includes a ball return mechanism having a ball storage mechanism, a ball passing device, and a track structure. The ball return system also includes one or more optical sensors configured to capture visual data from the player and communicate said data to a system controller that controls the operation of the ball return mechanism, wherein the ball return mechanism is configured to transfer balls from the storage mechanism to the passing device, wherein the passing device is slidably mounted to the track structure, wherein the passing device is configured to move laterally, vertically, and diagonally upon the track structure, and wherein the passing device is further configured to automatically project the balls toward the player positioned upon the playing surface, based on the visual data. In one aspect, the passing device is further configured to provide chest passes, bounce passes, and lob passes directed at the player based on the visual data, wherein the visual data includes player characteristics, location, and movements, and wherein the player movements include hand gestures. In another aspect, the passing device is further configured to vary the level of spin and force on the projected ball. In another aspect, the storage mechanism receives the balls from missed shot attempts made by the player, wherein the storage mechanism is configured to organize the balls by size, wherein the player movements include shot attempts, and wherein the system is configured to recognize which player is on the playing surface. In another aspect, the ball return mechanism is remotely operable and programmable via system presets, and wherein the system presets can be global or player-specific.

DETAILED DESCRIPTION

In the following discussion, numerous specific details are set forth to provide a thorough understanding of the disclosed subject matter. However, those skilled in the art will appreciate that the present disclosed subject matter may be practiced without such specific details. In other instances, well-known elements, processes or techniques have been briefly mentioned and not elaborated on in order not to obscure the disclosed subject matter in unnecessary detail and description. Moreover, specific details and the like may have been omitted inasmuch as such details are not deemed necessary to obtain a complete understanding of the disclosed subject matter, and are considered to be within the understanding of persons having ordinary skill in the relevant art.

The present invention is optimized for use in sports and activities that require the use of a ball, especially basketball. It includes one or more systems and mechanisms which can be integrated with a training space in order to enhance training and play for an athlete, or player. A ball return system is provided which includes a ball return mechanism having a movable passing device. The system can further be integrated with optical sensors such as cameras, and controllers gathering data from the cameras. In one example, the system processes data captured by the optical sensors in real-time during a training session in order to physically and automatically manipulate the ball return mechanism and its passing device via the controllers. The gathered data is largely derived from player characteristics and movements, including location and position changes within the training space and upon a playing surface, as well as hand gestures.

The system includes programmable features and presets which can also be implemented to operate the passing device, but also offers manual controls. Presets may be global or player-specific. Operation of the ball return mechanism and its passing device alters the nature of the pass, giving the player access to a plurality of pass types, including bounce passes, direct or chest passes, high or lob passes, spin passes, hard passes, and soft passes.

Figure 1:
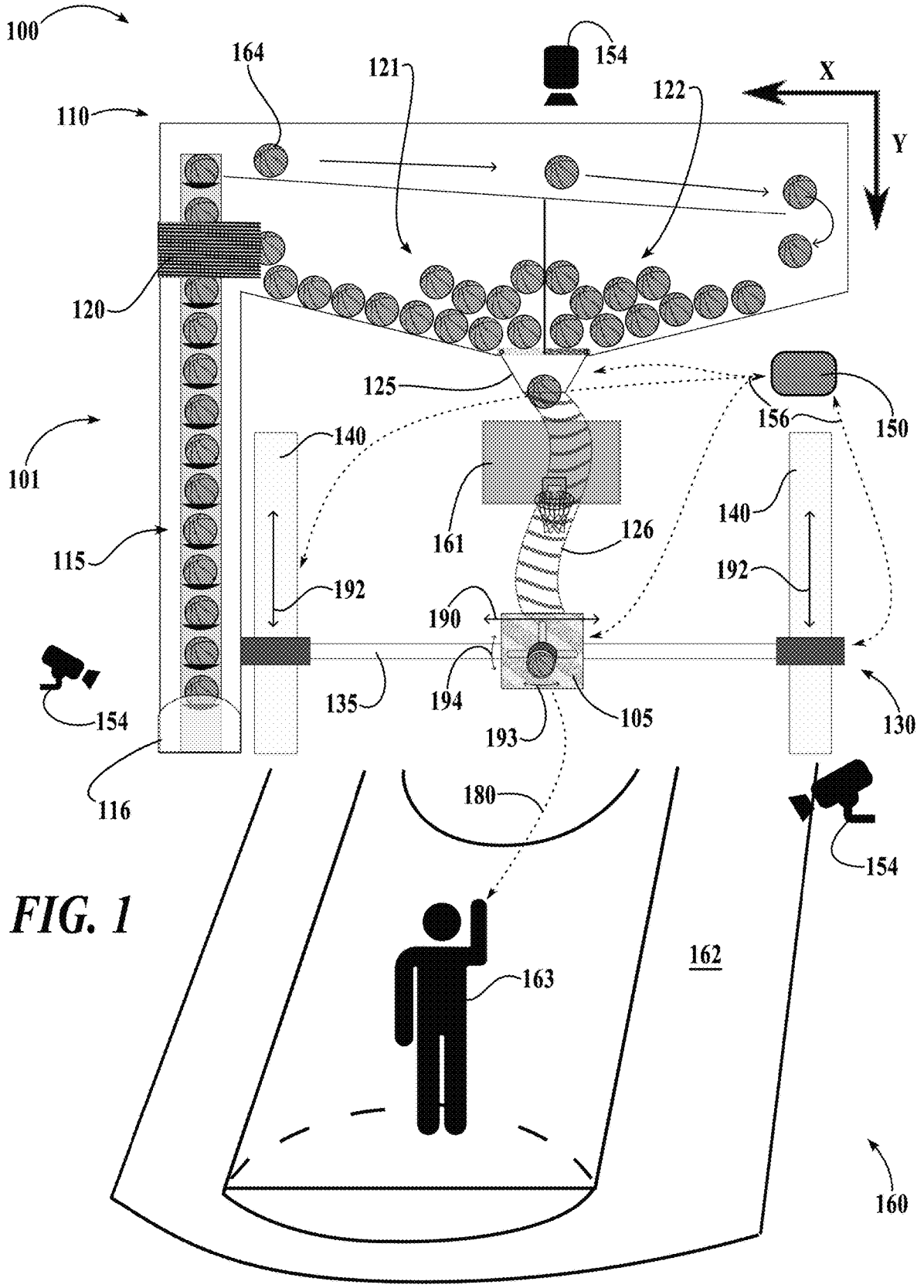
FIG. 1 illustrates interactions between a player and a programmable ball return system which includes a ball return mechanism for passing balls to a player from a variable location in accordance with an embodiment of the present disclosure.

Referring to FIG. 1, an illustration shows an exemplary embodiment of an interactive and programmable ball return system 100 installed within a court or training space 160, where an athlete or player 163 is positioned on a playing surface 162 of the training space, making shot attempts toward a goal structure 161 with a ball 164. The ball return system 100 is non-intrusively integrated with the training space 160, and comprises a ball return mechanism 101, a plurality of cameras or optical sensors 154, and a system controller 150 that all work in concert to timely provide a steady supply of balls 164 directly back to the player 163 as they shoot. The ball return mechanism 101 further comprises a ball storage mechanism 110 for receiving, organizing, storing, and expelling balls 164 into the training space 160 or transferring the balls to a passing device 105. The ball storage mechanism 110 further comprises one or more transport mechanisms 115, one or more ball sorting mechanisms 120, and a ball release mechanism 125. The ball transport mechanism 115 firstly receives and collects balls 164 and moves them through the ball storage mechanism 110. Secondly, the ball sorting mechanism 120 organizes the balls 164, selectively discharging them within the ball storage mechanism 110, placing them into either a first ball storage queue, or group 121 or a second ball storage queue, or group 122. Thirdly, the release mechanism 125 expels the balls 164 from the storage mechanism 110 and into the training space 160, or directly into the passing device 105. In another example, the ball storage mechanism 110 comprises a plurality of the above mechanisms, including the ball transport mechanism 115, ball sorting mechanism 120, and ball release mechanism 125, which may better accommodate a larger training space 160.

An exemplary ball storage mechanism 110 includes one or more ball transport mechanisms 115 further comprising an entry point 116 through which the balls 164 are received, and a vertical conveyor belt to move the balls from the entry point to the sorting mechanism 120 lying in its path. The received balls 164 include those from missed shot attempts made by the player 163 (see FIG. 6 for an example of corralling missed and made shots with a ball delivery assembly 641 that is operatively and structurally associated with a transport mechanism 115). The transport mechanism 115 with conveyor belt generally extends upward, away from the playing surface 162 and above the height of the goal structure 161. There, it forms a structural association with the sorting mechanism 120, as well as the storage groups 121 and 122 which are positioned more directly above the goal structure 161. Positioning the sorting mechanism 120 at a substantial height allows gravity to feed the balls 164 from it into the storage regions and release mechanism 125 that follow. One or more exemplary sorting mechanisms 120 process the balls 164 based on their diameter. The sorting mechanism 120 places a first size of ball, or smaller balls, into the first storage group 121, while a second size of ball, or larger balls, bypass it, continuing on the transport mechanism 115 to take a higher alternate path above the sorting mechanism to be carried along a ramp or conduit above the storage groups, such that gravity allows them to drop down into the second storage group 122. Once collected in the storage queues, each ball can be selectively expelled from their group via the release mechanism 125 into and funneled through a flexible hose or conduit 126, which connects the release mechanism to the ball passing device 105 positioned below it, providing a ball pathway to the passing device. The ball passing device 105 accepts the expelled balls from the release mechanism 125 and projects them onto the playing surface 162 while simultaneously pivoting via panning and/or tilting to alter the type of pass. Panning motion arrows 193 indicate the lateral pivoting of the passing device 105, this range of motion generally running parallel to the playing surface 162. Tilting motion arrows 194 indicate the vertical pivoting of the passing device 105, this range of motion generally running perpendicular to the playing surface 162. The passing device 105 automatically projects the ball 164 directly to the player 163 positioned on the playing surface 162. The projected ball's path is indicated by dashed ball trajectory line 180. In another example, the conduit 126 may be rigid but segmented for further adjustment or the addition of a plurality of connected conduits leading to other passing devices 105.

The passing device 105 is mounted upon a track structure 130, the track structure comprising a straight lateral motion mechanism 135 and a straight vertical motion mechanism 140. The vertical motion mechanism 140 further comprises two parallel vertical rails, each rail extending perpendicularly away from the playing surface 162, while the lateral motion mechanism 135 further comprises a lateral rail running orthogonally to and being slidably engaged with the vertical rails of the vertical motion mechanism. The ball passing device 105 is slidably mounted to the lateral rail of the lateral motion mechanism 135, and can travel along a substantial portion of the full length of the rail. The vertical motion mechanism 140 raises and lowers the lateral motion mechanism 135, while both the lateral motion mechanism and passing device 105 are mutually equipped to provide linear motion of the passing device along the lateral rail. In one example, the passing device 105 is motorized. The passing device 105 simultaneously projects the balls 164 while pivoting (via panning/tilting) and moving vertically, laterally, and diagonally relative to the playing surface 162 via the above motion mechanisms. Orthogonal first and second axes (being orthogonal relative to each other), or the X-Y axes, respectively, shown in the corner of the drawing are referentially associated with the vertical/lateral motion of elements within the track structure 130. In an exemplary training space 160, the X axis runs parallel to the playing surface 162, while the Y axis runs perpendicular to it. Vertical motion arrows 192 indicate up/down linear motion of the lateral motion mechanism 135 (and thus the mounted passing device 105), parallel with the Y axis. Lateral motion arrows 190 indicate lateral or side-to-side linear motion of the passing device 105 along the rail of the lateral motion mechanism 135, parallel with the X axis. In an exemplary embodiment, both the vertical motion mechanism 140 and the lateral motion mechanism 135 provide infinite repositioning of the passing device 105 along the track structure 130. In another embodiment, the track structure 130 is configured to provide linear motion of the passing device 105 in an additional direction running orthogonally to both the vertical and lateral motion.

The system controller 150 receives data from the optical sensors 154, and is in two-way communication with a number of sub-controllers, as indicated by two-way communication paths 156. In an exemplary embodiment, the sub-controllers are communicatively associated with the ball release mechanism 125, the vertical motion mechanism 140, the lateral motion mechanism 135, and the passing device 105. The system controller 150 generally serves as the master controller operating the aforementioned main functions of the above mechanisms. The optical sensors 154 capture visual data from the characteristics, location, and movements of the player 163. In one example, the optical sensors 154 are specialized cameras that allow the system 100 to recognize which player 163 is on the playing surface 162. The system controller 150 automatically translates the acquired visual data into sub-controller commands in real-time during training to affect the following: the vertical and lateral positions of the passing device 105, the releasing of balls 164 into the passing device 105, and the pivoting of the passing device 105. The above plurality of varied vertical, lateral, and pivoted positions of the passing device 105 provide chest passes, bounce passes, and lob passes directed at the player 163 based on player characteristics, location, and movements. The system controller 150 optionally executes the sub-controller commands based on system presets, manual controls, or external processing. In one example, the external processing is executed via an on-site or remote database. In another example, the external processing is executed via cloud-computing. The above elements thus provide for a ball return mechanism 101 that is remotely operable and programmable via system presets.

Figure 2:
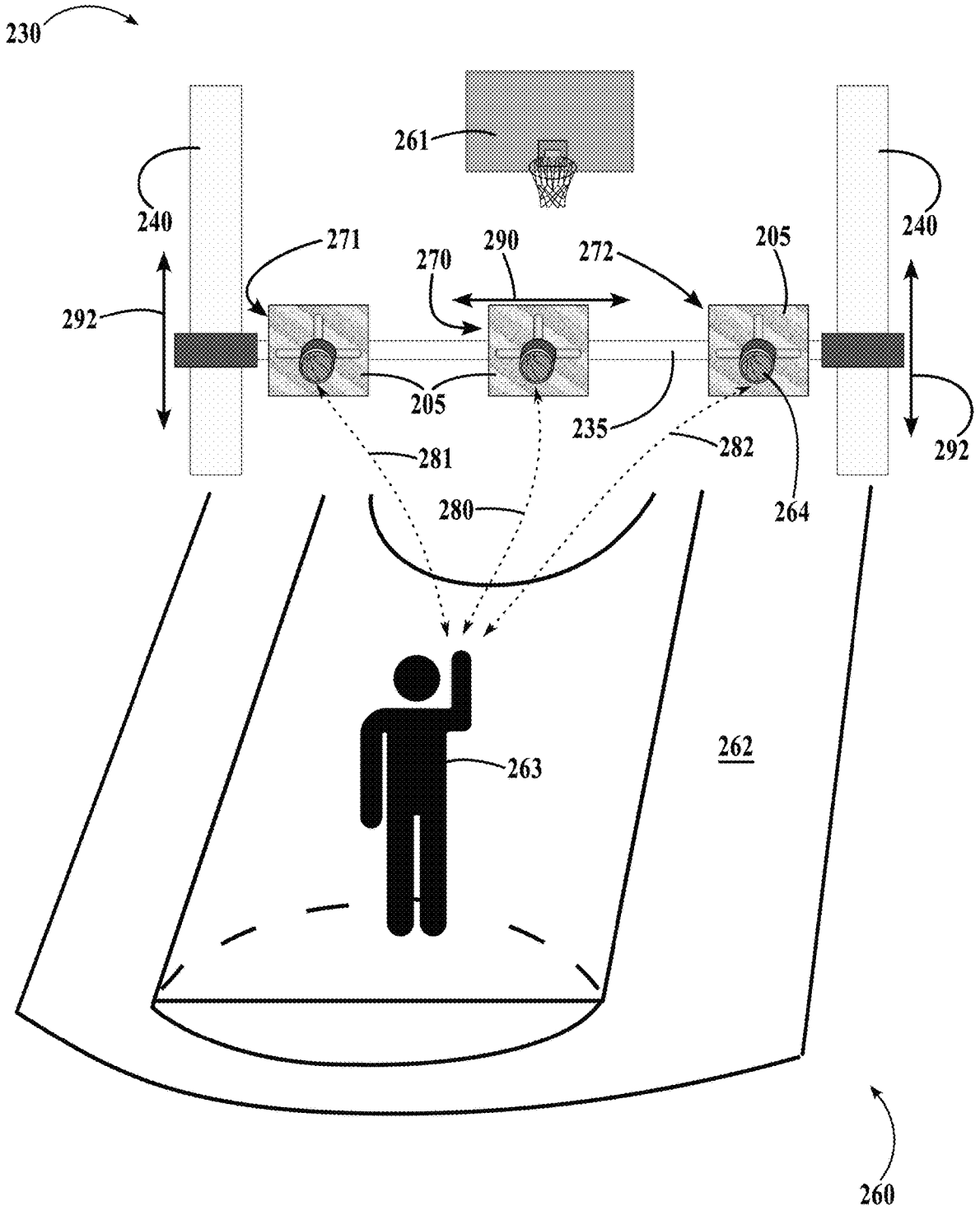
FIG. 2 illustrates the player receiving passes with varied trajectories and originating from a plurality of lateral positions occupied by a passing device of the ball return mechanism in accordance with an embodiment of the present disclosure.

Referring to FIG. 2, an illustration shows the player 263 receiving passes with varied trajectories and originating from a plurality of lateral positions occupied by the ball passing device 205 as it assumes different passing configurations. Training is enhanced, being more efficient since the player 263 can remain in a fixed position while the ball 264 is passed from varied positions. Directional references including "right" and "left" are made from the perspective of the player when facing the track structure 230. The training space 260 includes the track structure 230 installed upon the playing surface 262 in close proximity to the goal structure 261. The passing device 205 is slidably mounted to the lateral motion mechanism 235, which in turn is slidably engaged with the vertical rails of the vertical motion mechanism 240 for vertical adjustment, as indicated by motion arrows 292, allowing passes to originate from different heights relative to the player 263. Lateral motion arrows 290 indicate lateral motion of the passing device 205 along the lateral motion mechanism 235, this motion resulting in three different examples of lateral positions or configurations of the device 205. Position 270 indicates a lateral passing configuration A, position 271 indicates a lateral passing configuration B, and position 272 indicates a lateral passing configuration C, each passing configuration further being associated with a ball trajectory. Ball trajectory 280 results from lateral passing configuration A, which is centrally located relative to the player 263, such that the passing device 205 requires little to no panning to directly target the player. Ball trajectory 281 results from lateral passing configuration B, which places the passing device 205 to the left of the player 263. Ball trajectory 282 results from lateral passing configuration C, which places the passing device 205 to the right of the player 263. Lateral passing configurations B and C utilize lateral panning of the passing device 205 to directly target the player 263. All exemplary passing configurations can include varied levels of spin and force placed on the projected ball 264, providing unique ball trajectories for the player 263. Changes to these parameters are executed by a passing controller (see passing controller 551 of FIG. 5) based on visual data captured from the player 263.

Figure 3A:
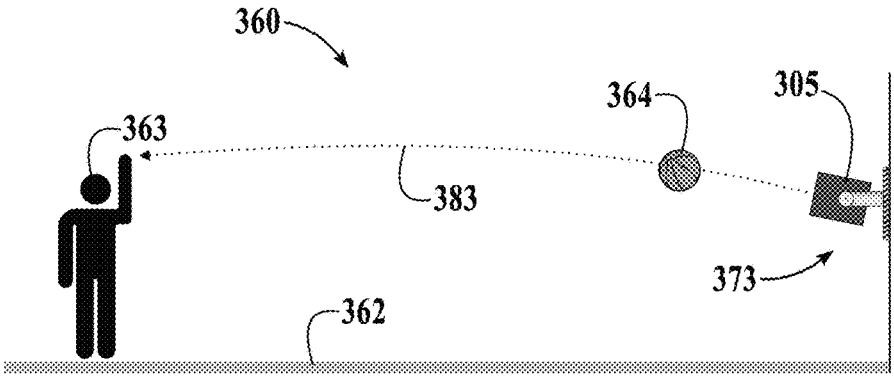
FIGS. 3A-C illustrate the player receiving passes with varied trajectories due to tilting of the passing device in accordance with an embodiment of the present disclosure.
Figure 3B:
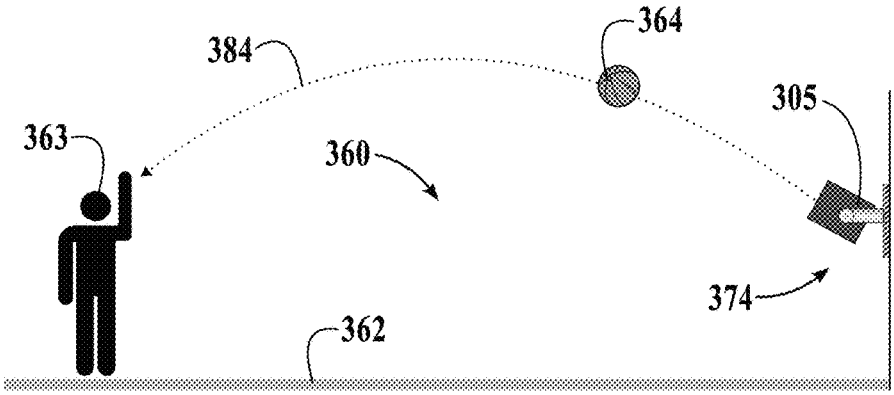
Figure 3C:
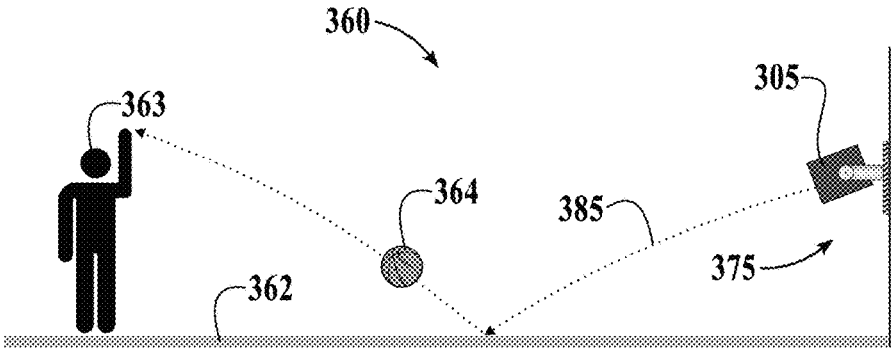

Referring to FIGS. 3A-C, illustrations show the player 363 receiving passes with varied trajectories caused by changing the angle of the pass from a fixed location relative to the player 363, namely a chest pass, lob pass and bounce pass, respectively. In these instances, the altered angle results from tilting the passing device 305 via vertical pivoting. Regarding FIG. 3A, the player 363 receives a chest pass while positioned on the playing surface 362 of the training space 360. A chest pass is characterized by a substantially horizontal trajectory (i.e. with minimal arc) relative to the playing surface 362. Here, a tilted position 373 of the passing device 305 indicates tilted passing configuration A, whereby the ball 364 is directed substantially straight to the player 363, bypassing the playing surface 362, as indicated by tilted ball trajectory 383. In FIG. 3B, the player 363 receives a lob pass while positioned on the playing surface 362 of the training space 360. A lob pass is characterized by a more parabolic trajectory (i.e. more arc) relative to the playing surface 362 such that the ball reaches a maximum height well above the player's head before traveling downward. In this second example, a tilted position 374 of the passing device 305 indicates tilted passing configuration B, whereby the ball 364 is directed substantially upward before reaching the player 363, still bypassing the playing surface 362, as indicated by tilted ball trajectory 384. In FIG. 3C, the player 363 receives a bounce pass while positioned on the playing surface 362 of the training space 360. A bounce pass is characterized by a substantially v-shaped trajectory relative to the playing surface 362. In this third example, a tilted position 375 of the passing device 305 indicates tilted passing configuration C, whereby the ball 364 is first directed toward the playing surface 362, causing it to bounce before reaching the player 363, as indicated by tilted ball trajectory 385. In all tilted passing configurations, the amount of force used to propel the ball 364 is variable and based on both player location and the desired force of the pass.

Figure 4:
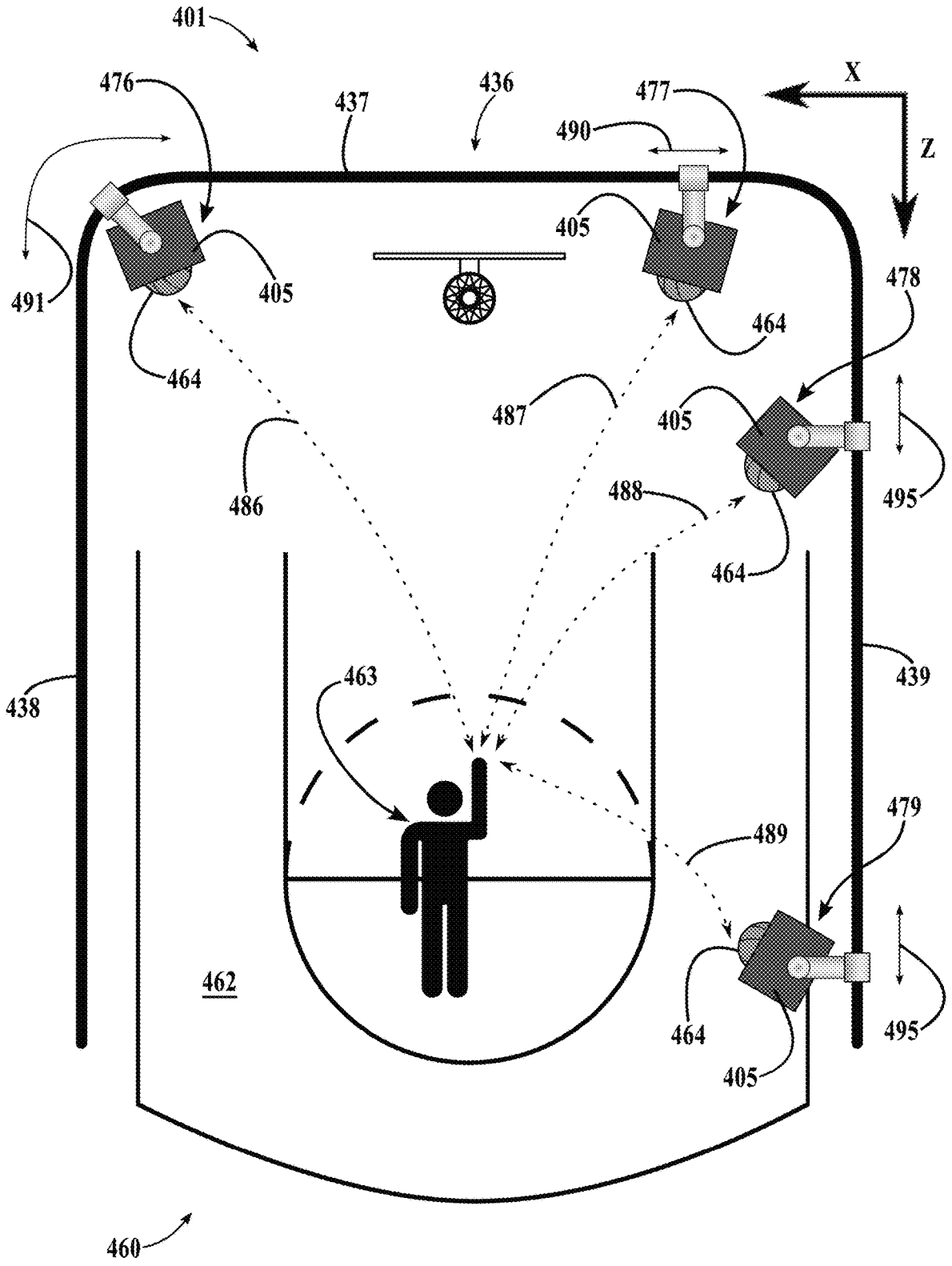
FIG. 4 illustrates the player receiving passes with varied trajectories and originating from a plurality of lateral positions occupied by the passing device as it simultaneously pans to target the player in accordance with an embodiment of the present disclosure.

Referring to FIG. 4, an illustration shows another implementation of a ball return mechanism 401 for passing balls 464 to a player 463 positioned on a playing surface 462. The ball passing device 405 follows straight and curved lateral paths along a rail or track, or curved lateral motion mechanism 436 to which the device 405 is slidably mounted, allowing the passing device to move laterally while positioned frontally relative to the player 463 and laterally along two lengthwise sides of the training space 460 relative to the player 463. An exemplary lateral motion mechanism 436 has a plurality of coplanar rails surrounding a substantial region of the playing surface 462 for lateral passing of the ball 464. FIG. 4 also illustrates the panning function of the passing device 405 as it simultaneously moves linearly/laterally, allowing the player 463 to receive the ball 464 from nearly any position along the full length of the track. The passing device 405 pivots via both panning and tilting during the simultaneous linear motions. In this embodiment, though all motions of the passing device 405 are practically described as lateral relative to the player 463 during training, it is helpful to further delineate differences between these types of movement using the training space 460 and playing surface 462 as objects of reference. Motion arrows 490 indicate movement of the passing device 405 along a straight portion of the track, a first rail 437, running widthwise along the playing surface 462. A straight second rail 438 and third rail 439 of the track connect to the first rail 437 via terminal curvatures, the ball passing device 405 traveling between the three rails via the curvatures. Motion arrows 491 indicate curving movement of the passing device 405 as it travels between the first rail 437 and the second and third rails 438 and 439, respectively, the latter two rails running lengthwise along the playing surface 462 and parallel to each other, whereupon the passing device moves longitudinally through the training space 460, as indicated by motion arrows 495. Orthogonal first and third axes (being orthogonal relative to each other), or the X-Z axes, respectively, shown in the corner of the drawing are imaginary axes that are referentially associated with the widthwise and longitudinal motion, respectively, of the passing device 405 along the curved lateral motion mechanism 436. In an exemplary training space 460, the X axis runs parallel to the width of the playing surface 462 or training space, corresponding to the first rail 437, while the Z axis runs parallel to the length of the playing surface or training space, corresponding to the second rail 438 and third rail 439. Thus, motion arrows 490 of the passing device 405 run parallel to the X axis, while motion arrows 495 of the passing device 405 run parallel to the Z axis, with curving motion arrows 491 of the passing device 405 running at angles between the two imaginary axes. The passing device 405 provides chest passes, bounce passes, and lob passes with variable force and spin to the player 463 while varying its position along the curved lateral motion mechanism 436 as the player 463 varies their position upon the playing surface 462.

In an exemplary embodiment, the curved lateral motion mechanism 436 provides infinite repositioning of the device 405 via the above three motions of the passing device 405; several examples of these positions are illustrated. Position 476 indicates a panned lateral passing configuration A, position 477 indicates a panned lateral passing configuration B, position 478 indicates a panned lateral passing configuration C, and position 479 indicates a panned lateral passing configuration D, each passing configuration further being associated with a ball trajectory. Ball trajectory 486 results from panned lateral passing configuration A, which places the passing device 405 between the first rail 437 and second rail 438 as it pans to target the player 463 while moving along the track via motion 491. Ball trajectory 487 results from panned lateral passing configuration B, which places the passing device 405 on the first rail 437, frontally and to the right of the player 463 and panning only slightly to target the player. Ball trajectory 488 results from panned lateral passing configuration C, which places the passing device 405 on the third rail 439 as it pans sharply to target the player 463 frontally and further to the right, yet at a more oblique angle. Ball trajectory 489 results from panned lateral passing configuration D, which places the passing device 405 much further forward along the third rail 439 as it pans similarly sharply to target the player 463 from the rear, at yet another highly oblique angle.

Though not illustrated in FIG. 4, in another example of this embodiment, the ball return mechanism 401 includes a modified version of the previously mentioned ball storage mechanism to receive the balls 464, sort the balls according to size, and release the balls to the passing device 405. In yet another example, the ball return mechanism 401 is remotely programmable and operable via a system controller in two-way communication with the ball return mechanism 401. Further in this example, a plurality of cameras capture real-time motion data from the player 463, and the system controller receives and processes this data, converting it into commands which alter the type of pass, and which also direct the pass directly to the player 463 positioned on the playing surface 462 (see system controller 150 and cameras 154 of FIG. 1).

Figure 5:
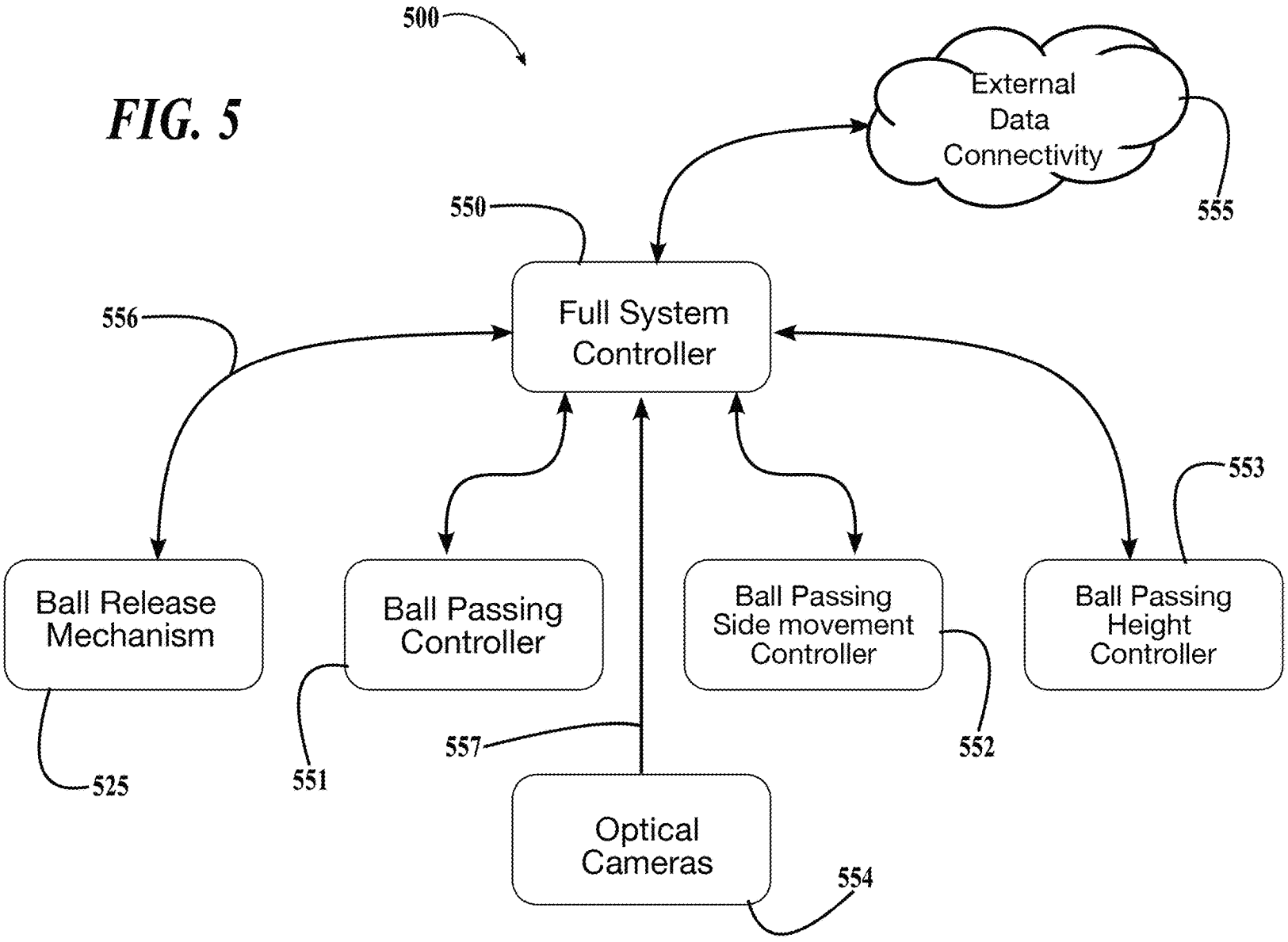
FIG. 5 illustrates a diagram outlining the communication paths between a system controller and various sub-controllers and other elements associated with the ball return system in accordance with an embodiment of the present disclosure.

Referring to FIG. 5, an illustration shows a diagram outlining the communication paths 556 and 557 between the system controller 550 and various sub-controllers, along with an option for external data connectivity 555 for processing commands for the ball return system 500. Cameras or optical sensors 554 provide a real-time stream of player movement data to the system controller 550, as indicated by one-way communication path 557. The player data can comprise information about player characteristics, location, hand gestures, and shot attempts, including missed or made shots. Variations of hand gestures can further signal desired passing targets, as well as types of passes, including chest passes, bounce passes, and lob passes. The player characteristics can include height, size, facial features, and wearable articles, such as those with a distinct coloration or color pattern. In another embodiment, the wearable article emits a wavelength outside of the visible spectrum of light, such as infrared, which is registered by additional sensors or integrated with the existing optical sensors 554. The wearable article can provide a constant location signal, or be manipulated by the player to push specific commands to the system controller 550, thereby initiating or affecting passes. Further in such an embodiment, the player's own body heat can be registered by the sensors and system controller as usable data for determining player location and movements.

Using the above data received by the optical sensors 554, the system controller 550 sends control commands to a plurality of sub-controllers associated with the ball return mechanism. The sub-controllers include the ball release mechanism 525, the ball passing controller 551, a lateral motion controller 552, and a vertical motion controller 553, and are in two-way communication with the system controller 550, as indicated by two-way communication paths 556. The ball release mechanism 525 is triggered by the system controller 550 to release a ball to the passing device (see the passing device shown in all previous figures, e.g. passing device 105), queueing it up for passing to the player. In one example, the ball release mechanism 525 can likewise provide basic information to the system controller 550 about the presence of a ball inside of it, or lack thereof, incoming balls, or a jam in the mechanism 525. The system controller 550 also integrates location data about the passing device with the athlete's present location data, along with the desired type of pass, processing this data into a command sent to the ball passing controller 551 to initiate a pass with the correct force, azimuth, and elevation needed to target the player. Player hand gestures can optionally initiate the pass. The lateral motion controller 552 receives lateral position data from the system controller 550, and uses this data to move laterally to the desired position. Similarly, the vertical motion controller 553 receives vertical position data from the system controller 550, and uses this data to move vertically to the desired position. In another example, the system controller 550 relays optical data to an external, cloud-based computational engine, or data processor 555 to determine player location, which is then passed back to the system controller 550. Externalizing such processing and data sets can serve to minimize and streamline on-site hardware within a training space, easing setup procedures, and establishing a foundation for travel-friendly setups, as well as simplifying the use of modular setups.

The system controller 550 sends control commands to all sub-controllers to pass the ball to the player based on the following: the desired workout program selected by the player, the physical location of the player on the court based on optical analysis, hand gestures or other visually-determined commands initiated by the player, and external prompts via connection to other systems. The system controller 550 can operate using programmable features and presets which can also be implemented to manipulate the passing device. Presets may be global or player-specific. The player-specific system presets can be age-based, allowing younger players to ease into beginner's training, while more experienced players can opt for more rigorous training.

Figure 6:
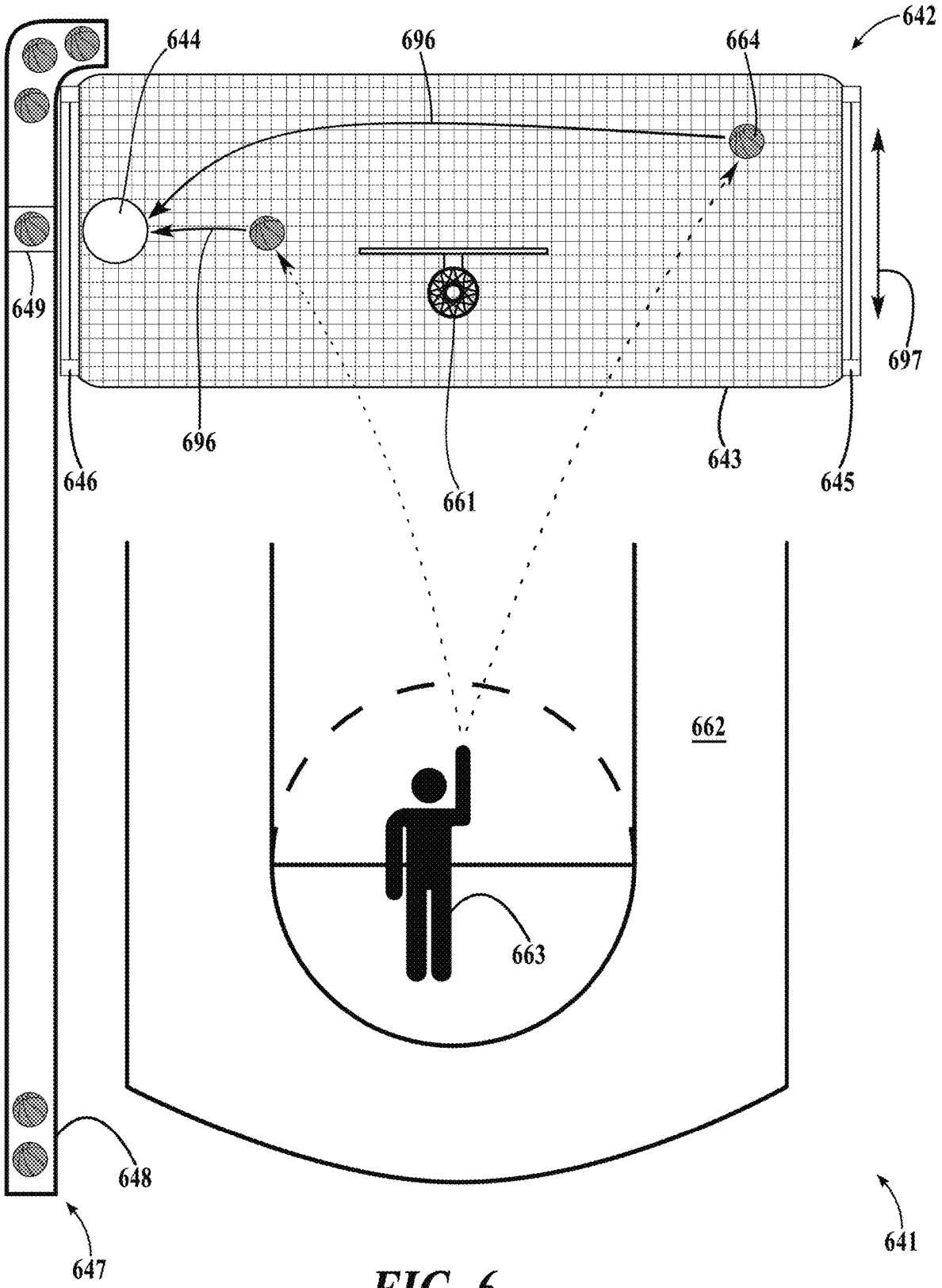
FIG. 6 illustrates a ball delivery assembly capturing and directing balls from missed shot attempts by a player in accordance with an embodiment of the present disclosure.

Referring to FIG. 6, an illustration shows a ball delivery assembly 641 capturing and directing balls 664 from missed shot attempts by a player 663. The ball delivery assembly 641 further comprises a ball-catching structure 642 and a ball delivery pathway 647. The ball-catching structure 642 is ideally placed below the goal structure 661 and nearer to the playing surface 662 in order to capture not only made shots but also missed shot attempts. The ball-catching structure 642 further comprises a flexible ball-catching material 643 and a set of two parallel tracks, including a first ball-catching material track, or upper track 645 and a second ball-catching material track, or lower track 646. The ball-catching material 643 has a length and width. The length of the material 643 extends substantially across the width of the playing surface 662, while the width of the material 643 extends across a small portion of the length of the playing surface 662. Each widthwise end of the ball-catching material 643 is slidably engaged with one of the two tracks, so that the material 643 is retractable from the deployed configuration shown, in a backward direction away from the player 663, usually toward a back wall and into a stored configuration. Motion arrows 697 indicate the forward/backward adjustment of the ball-catching material 643 along the two tracks. The upper track 645 is positioned higher than the lower track 646 relative to the playing surface 662, so that captured balls 664 are naturally directed downward toward the playing surface 662 via gravity, and toward the lower track 646. In an exemplary embodiment, the flexible ball-catching material 643 consists of durable, thick netting which is optimized to regulate sag due to the bouncing and rolling balls 664 making contact with it. The ball-catching material 643 further comprises an exit hole 644 that is positioned adjacent to the lower track 646. The exit hole 644 thus accepts incoming balls 664 which are directed toward it along the ball-catching material 643. Motion arrows 696 indicate the curving downward movement of the balls 664 toward the exit hole 644. Once dropped through the exit hole 644, each ball travels along a transition ramp 649 of the delivery pathway 647 in order to reach a delivery track 648 of the delivery pathway. An exemplary delivery track 648 consists of a set of two parallel rails, each of which are tubular and preferably composed of steel. One portion of the delivery pathway 647 terminates adjacent to the ball-catching structure 642, while another portion terminates elsewhere on the court and near the playing surface 662. Each terminal portion of the delivery pathway 647 can empty into a ball return mechanism (specifically, directed into the entry point 116 of the transport mechanism 115 depicted in FIG. 1, or alternatively directed immediately to the sorting mechanism 120 in an example where the delivery pathway 647 doubles as a transport mechanism 115), such that a single pathway can serve a plurality of ball return mechanisms, funneling balls thereto. In another example, each ball return mechanism can correspond with its own delivery pathway 647. An exemplary delivery pathway 647 is slanted so that gravity passively moves the balls 664 along the delivery track 648. The delivery pathway 647 can include one or more bends along the delivery track 648 to accomplish this, thus slanting at different angles along the track, especially in an embodiment where a single pathway 647 serves multiple ball return mechanisms. Alternatively, one or both of the transition ramp 649 and delivery track 648 can be enclosed conduits.

Many variations may be made to the embodiments described herein. All variations are intended to be included within the scope of this disclosure. The description of the embodiments herein can be practiced in many ways. Any terminology used herein should not be construed as restricting the features or aspects of the disclosed subject matter. The scope should instead be construed in accordance with the appended claims.

There may be many other ways to implement the disclosed embodiments. Various functions and elements described herein may be partitioned differently from those shown without departing from the scope of the disclosed embodiments. Various modifications to these implementations may be readily apparent to those skilled in the art, and generic principles defined herein may be applied to other implementations. Thus, many changes and modifications may be made to the disclosed embodiments, by one having ordinary skill in the art, without departing from the scope of the disclosed embodiments. For instance, different numbers of a given element or module may be employed, a different type or types of a given element or module may be employed, a given element or module may be added, or a given element or module may be omitted.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

What is claimed is:

1. A ball return system integrated with a playing surface upon which a player trains, the ball return system comprising:

A ball return mechanism that includes:

(a.) a ball storage mechanism, the storage mechanism further comprising:

i. one or more ball transport mechanisms configured to receive balls and move them through the storage mechanism;

ii. one or more ball sorting mechanisms configured to selectively discharge the balls within the storage mechanism;

iii. one or more ball storage groups;

iv. a ball release mechanism;

wherein the balls are firstly received by the one or more transport mechanisms, secondly organized by the one or more sorting mechanisms into the one or more storage groups, and thirdly expelled from the storage mechanism by the release mechanism;

(b.) a ball passing device configured to accept the expelled balls from the release mechanism, the passing device further configured to pivot via panning and tilting;

(c.) a track structure having both lateral and vertical motion mechanisms;

i. the vertical motion mechanism comprising two parallel vertical rails, each rail extending perpendicularly away from the playing surface;

ii. the lateral motion mechanism comprising a lateral rail running orthogonally to and being slidably engaged with the vertical rails, the passing device being slidably mounted to the lateral motion mechanism;

wherein the vertical motion mechanism is configured to raise and lower the lateral motion mechanism with passing device, while both the lateral motion mechanism and passing device are mutually configured to provide linear motion of the passing device along the lateral rail, wherein the passing device simultaneously projects the balls onto the playing surface while pivoting and moving vertically, laterally, and diagonally relative to the playing surface via said motion mechanisms;

The ball return system further comprising optical sensors and a system controller, the system controller receiving data from the optical sensors, the system controller further being in two-way communication with sub-controllers, including:

(a.) a passing controller;

(b.) a lateral motion controller;

(c.) a vertical motion controller;

(d.) the ball release mechanism; and, wherein the optical sensors capture visual data from player characteristics, location, and movements, wherein the system controller automatically translates this data into sub-controller commands in real-time during training to affect one or more of the following: the vertical and lateral positions of the passing device, the pivoting of the passing device, and the releasing of balls into the passing device, wherein the above plurality of varied vertical, lateral, and pivoted positions of the passing device provide chest passes, bounce passes, and lob passes directed at the player based on the visual data, and wherein the system controller optionally executes the sub-controller commands based on system presets, manual controls, or external processing of the visual data.

2. The ball return system of claim 1, wherein the passing device is configured to vary the level of spin and force on the projected ball, and wherein changes to these parameters are executed by the passing controller based on the visual data.

3. The ball return system of claim 2, wherein one or more of the transport mechanisms further comprise an entry point through which the balls are received, wherein the received balls include those from missed shot attempts made by the player, wherein one or more of the ball sorting mechanisms organize the balls by size, and wherein the release mechanism includes a conduit providing a ball pathway to the passing device.

4. The ball return system of claim 3, wherein one or more of the entry points are positioned at the level of the playing surface, and wherein a first storage group holds a first size of ball and a second storage group holds a second size of ball.

5. The ball return system of claim 4, wherein the conduit is flexible, and wherein both the vertical and lateral motion mechanisms are configured to provide infinite repositioning of the passing device along the track structure.

6. The ball return system of claim 2, wherein the system presets can be global or player-specific.

7. The ball return system of claim 6, wherein the visual data includes hand gestures and shot attempts by the player, including missed or made shots, wherein the hand gestures can initiate passes, and wherein variations of hand gestures are associated with different types of passes.

8. The ball return system of claim 7, wherein the player-specific system presets can be age-based.

9. The ball return system of claim 8, wherein the external processing is cloud-based, wherein one or more of the transport mechanisms further comprise an entry point through which the balls are received, wherein the received balls include those from missed shot attempts made by the player, and wherein one or more of the ball sorting mechanisms organize the balls by size.

10. The ball return system of claim 9, wherein the track structure is configured to provide linear motion of the passing device in an additional direction running orthogonally to both the vertical and lateral motion.

* * * * *